US005267733A

United States Patent [19]

Szokola

[11] Patent Number: 5,267,733

[45] Date of Patent: Dec. 7, 1993

[54] GOLF PUTTER

[76] Inventor: Dennis W. Szokola, 15219 Reeck Rd., Southgate, Mich. 48195

[21] Appl. No.: 923,775

[22] Filed: Aug. 3, 1992

[51] Int. Cl.[5] ..... A63B 53/04

[52] U.S. Cl. ..... 273/167 G; 273/80 C; 273/80.1; 273/80.2

[58] Field of Search ..... 273/80 C, 167 G, 80.1, 273/80.2, 164.1, 79

[56] References Cited

U.S. PATENT DOCUMENTS

| | | | |
|---|---|---|---|
| 2,478,468 | 8/1949 | Drake | 273/80 C |
| 2,846,228 | 8/1958 | Reach . | |
| 3,096,982 | 7/1963 | Bassin | 273/80.1 |
| 3,220,733 | 11/1965 | Saleeby . | |
| 3,655,188 | 4/1972 | Solheim . | |
| 3,675,923 | 7/1972 | Allen et al. | 273/80 C X |
| 3,749,408 | 7/1973 | Mills . | |
| 3,815,910 | 6/1974 | Raines | 273/80 C |
| 3,989,257 | 11/1976 | Barr | 273/164.1 X |
| 4,138,117 | 2/1979 | Dalton | 273/80 C X |
| 4,325,553 | 4/1982 | Taylor . | |
| 4,629,193 | 12/1986 | Pierman | 273/80 C X |
| 4,655,459 | 4/1987 | Antonious . | |
| 4,702,477 | 10/1987 | Solomon | 273/80 C |
| 4,722,528 | 2/1988 | Tsao | 273/80 C X |
| 4,815,740 | 3/1989 | Williams et al. | 273/80.1 |
| 5,160,141 | 11/1992 | Crews | 273/80.2 X |

FOREIGN PATENT DOCUMENTS

| | | | |
|---|---|---|---|
| 1129314 | 10/1968 | United Kingdom | 273/80.1 |

*Primary Examiner*—V. Millin
*Assistant Examiner*—Raleigh W. Chin
*Attorney, Agent, or Firm*—Basile and Hanlon

[57] ABSTRACT

A golf putter includes an elongated, linear shaft and a club head having a striking face. A hosel is mounted on a back surface of the club head and centered between the heel and toe of the club head. An arcuate section is connected between the shaft and the hosel. In one embodiment, the hosel and the end of the arcuate section connected to the shaft are spaced from the bottom of the club head a distance equal to the radius of a golf ball. The arcuate section includes an end leg connected to the hosel and having a length such that when the end leg is connected to the hosel, the striking face of the club head is spaced from the longitudinal axis of the shaft a distance equal to the radius of a golf ball. In one embodiment, the shaft is initially loosely connected to the hosel for angular adjustment with respect to the club head before being fixedly attached to the hosel.

10 Claims, 2 Drawing Sheets

GOLF PUTTER

BACKGROUND OF THE INVENTION

1. Field of the Invention

The present invention relates, in general, to golf clubs and, more specifically, to golf putters.

2. Description of the Art

Most golf putters are designed on the theory that a golf ball contacting the club face of the golf putter at the effective center of mass or sweet spot of the club head will travel in its intended direction. Since it is difficult to determine the effective center of mass of a club head, golf putters have been designed with various markings or indicia to assist the golfer in aligning the center of mass with the center of the golf ball. Such markings are typically in the form of lines placed on the top surface of the club head.

However, despite the soundness of the above-described theory, it is possible to strike a golf ball at the center of mass of a club head and still drive the golf ball at an angle to its intended path due to unintentional opening or closing of the club face with respect to the ball at the point of contact between the club face and the ball. The terms "open club face" and "closed club face" are used to describe the angle between the club face at the point of contact with a golf ball and the intended path of movement of the ball. An opened or closed club face places the striking face of the club head at a non-perpendicular angle with respect to a plane extending centrally through the golf ball and aligned with the intended path of ball movement and will cause the golf ball to move at an angle away from its intended path. Further, any rotation of the golfer's hands about the longitudinal axis of the shaft will impart an angular rotation or spin to the ball thereby increasing any offline movement of the ball or, at the least, a decrease in the amount of travel of the ball. Various attempts to enlarge the sweet spot on a golf club and in particular, on a golf putter, do not overcome the problems resulting from an opened or closed club face during a swing.

Golf putters are also provided with various attachment points for the golf shaft to a hosel on the club head. The club shaft, in a typical golf putter design, extends at an angle from a perpendicular line extending upward from the club head and is attached to a top surface of the club head. Other golf putter designs employ an offset section at the end of the shaft which places the longitudinal axis of the shaft slightly ahead of the striking surface of the club head. However, in this design, the hosel is still connected to the club head at the heel portion of the club head. Due to size differences in height, as well as torso, arm length and leg length from person to person, it is difficult for a golfer to find a golf putter having the proper shaft length and shaft angle with respect to the club head. Further, even if the proper sized golf putter is found, it is difficult for the average player to consistently swing a golf putter so as to strike a golf ball without opening or closing the club face. Further, previously devised putters fail to provide any means to indicate that the club head is opened or closed at the time of contact between the ball and the club head. In addition, previously devised golf putters do not provide sensory feedback of a proper, centered strike of the ball.

Thus, it would be desirable to provide a golf putter which overcomes the above-described problems with previously devised golf putters. It would also be desirable to provide a golf putter which provides an efficient transfer of golf swing energy to a golf ball. It would also be desirable to provide a golf putter which minimizes any tendency to open or close the striking face of the club head with respect to a golf ball during a swing. It would also be desirable to provide a golf putter which enables a player to swing the putter in an arc directly perpendicular to a plane extending centrally through a golf ball and aligned with the intended path of movement of the golf ball without any rotation of the player's hands about the longitudinal axis of the golf club shaft.

SUMMARY OF THE INVENTION

The present invention is a golf putter which provides an efficient transfer of golf swing energy to a golf ball and, further, which minimizes any tendency to open or close the club face with respect to the golf ball during a swing.

In a preferred embodiment, the golf putter includes an elongated, linear shaft having a hand grip end and an opposed end. A club head having a top surface, a sole, a heel, a toe, a planar striking face and a back wall opposed to the striking face is also provided. A hosel is mounted on the back wall centered between the heel and toe of the club head. An arcuate shaft section is connected between the opposed end of the shaft and the hosel to connect the shaft to the club head at the lateral center of the club head. The arcuate shaft section may be an integral extension of the shaft or it may be formed as a separate component and connected to the opposed end of the shaft.

In one embodiment, the hosel is centered between the top and sole portions of the club head. In another embodiment, the longitudinal axis of the hosel is spaced from the sole of the club head at a distance equal to the radius of a standard golf ball. The arcuate section connecting the shaft to the hosel includes an end leg connected to the hosel. The end leg has a predetermined length such that when the end leg is connected to the hosel, the striking face of the club head is spaced from the longitudinal axis of the shaft by a distance equal to the radius of a standard golf ball.

In another embodiment, the shaft and arcuate sections are connected to the club head such that a plane containing the longitudinal axis of the shaft and the arcuate shaft section is substantially perpendicular to the plane of the striking face of the club head. The shaft may also be variably positionable with respect to the striking face of the club head so as to be able to be moved to a selected position before being fixedly attached to the club head.

The golf putter of the present invention uniquely provides an efficient transfer of golf swing energy to a golf ball by centering the attachment point of the shaft to the hosel mounted on the club head at the lateral center of and between the top and sole portions of the club head. By centering the hosel between the top and sole portions of the club head such that the longitudinal axis of the hosel is spaced from the sole portion of the club head at a distance equal to the radius of a standard golf ball, the golf swing energy or inertia is transmitted directly to the center of a golf ball thereby providing efficient energy transfer and a more accurate propulsion force on the golf ball to propel the golf ball along its intended path without any variation therefrom. This arrangement also provides a good "feel" or response through the shaft to the golfer's hands when the ball is struck. Further, by centering the arcuate section connecting the shaft to the hosel between the heel and toe portions of the club head, it is easier for a player to bring the striking face of the club head into contact with the golf ball in a position in which the striking face of the club head is substantially perpendicular to a plane extending through the golf ball and aligned with the intended path of movement of the golf ball. Further, the golf putter of the present invention enables a player to easily correct any opening or closing of the striking face of the club during the swing to prevent any variation of the ball from its intended path of movement.

In an alternate embodiment, the shaft and arcuate section connected thereto are disposed substantially perpendicular to the striking face of the club head. This minimizes any tendency to open or close the club head during the swing. In another embodiment, the shaft is initially variably positionable from the above described perpendicular position with respect to the club head to an angular, non-perpendicular position ideally suited to a player's particular height, size and body parts relationship before being fixedly connected to the hosel.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
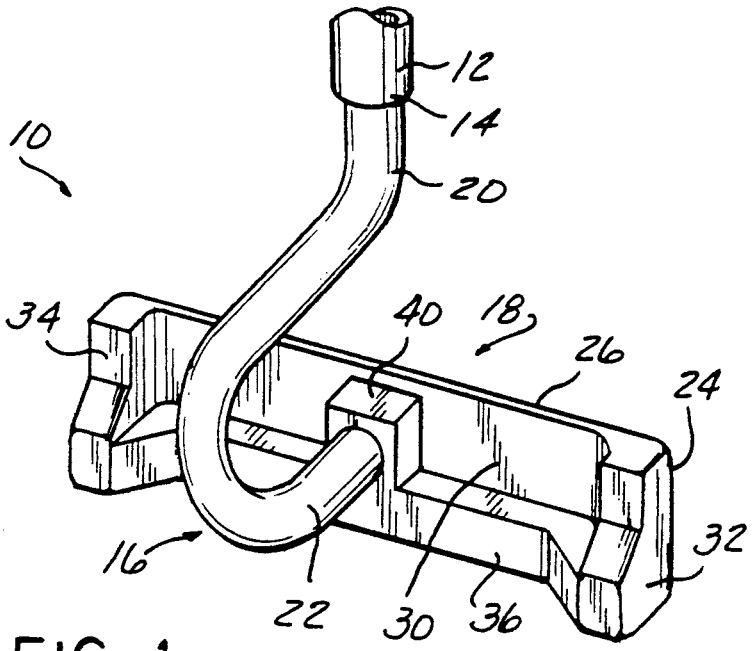
FIG. 1 is a perspective view of a golf putter constructed in accordance with the teachings of one embodiment of the present invention.

Referring now to the drawing, and to FIGS. 1–4 in particular, there is depicted one embodiment of a golf putter 10 constructed in accordance with the teachings of the present invention. The golf putter 10 includes a conventional elongated, substantially linear shaft 12 which extends from a hand grip end, not shown, to an opposed end 14. The shaft 12 may be formed of any suitable material, such as steel, wood, graphite, composites and combinations thereof. The shaft 12 may be solid or hollow and, further, may have a constant cross section along its length or it may be provided with a gradually decreasing diameter so as to provide tapering side walls from the hand grip end to the opposed end 14.

Figure 6:
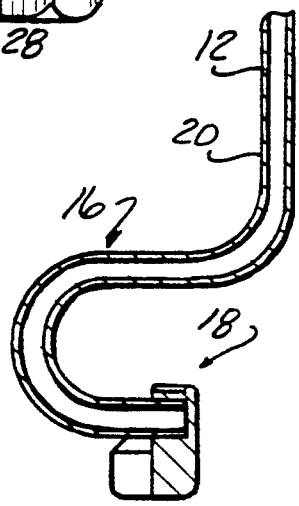
FIG. 6 is a partial, cross sectional view of an alternate embodiment of an integral shaft and arcuate section of the golf putter of the present invention.

According to the present invention, the golf putter 10 includes an arcuate portion 16 which extends between and is connected to the opposed end 14 of the shaft 12 and a club head 18. The arcuate section 16 includes a first end 20 which is integrally formed as a continuous extension of the shaft 12 as shown in FIG. 6 or in a separate component connected to the opposed end 14 of the shaft 12 by conventional means, as shown in FIG. 3.

Figure 3:
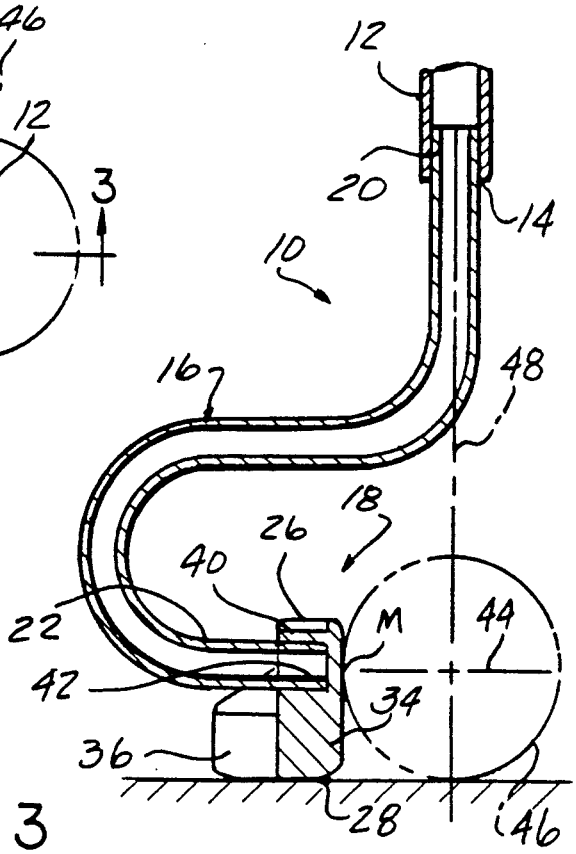
FIG. 3 is a cross sectional view generally taken along line 3—3 in FIG. 2.
Figure 4:
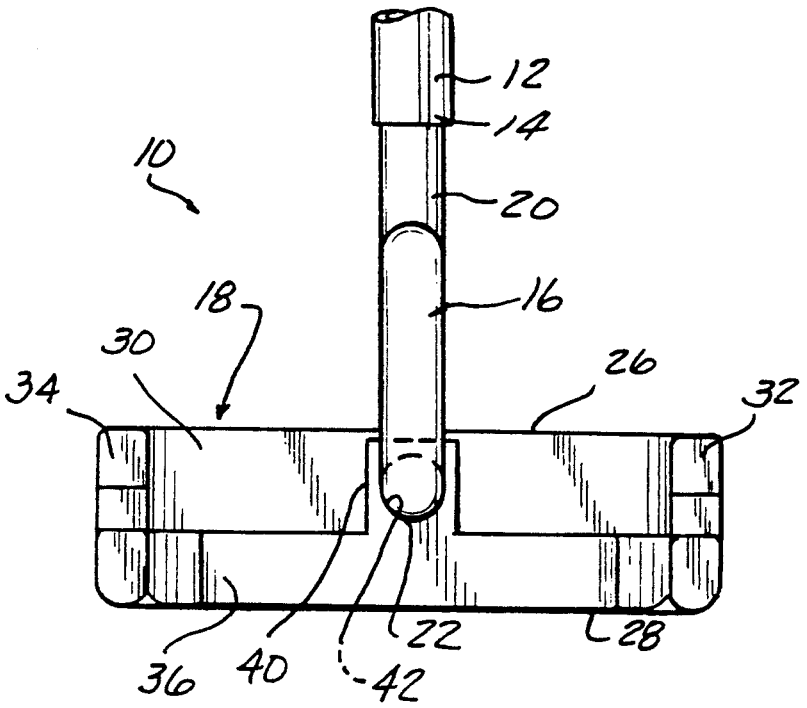
FIG. 4 is a back elevational view of the golf putter shown in FIG. 1.

The arcuate section 16 may have any shape, such as the smoothly curved shape shown in FIGS. 1 and 3. Alternately, the arcuate section 16 may have a more generally straight sided, angular shape. It is important, however, that the arcuate section 16 be formed so as to have an end le portion 22 extending perpendicularly from the club head 18 and located behind the back wall of the club head 18 as described hereafter.

The club head 18 has a striking face 24 of generally planar configuration, a top surface 26, a bottom or sole surface 28, a rear or back wall surface 30, a toe end 32 and a heel end 34.

Figure 2:
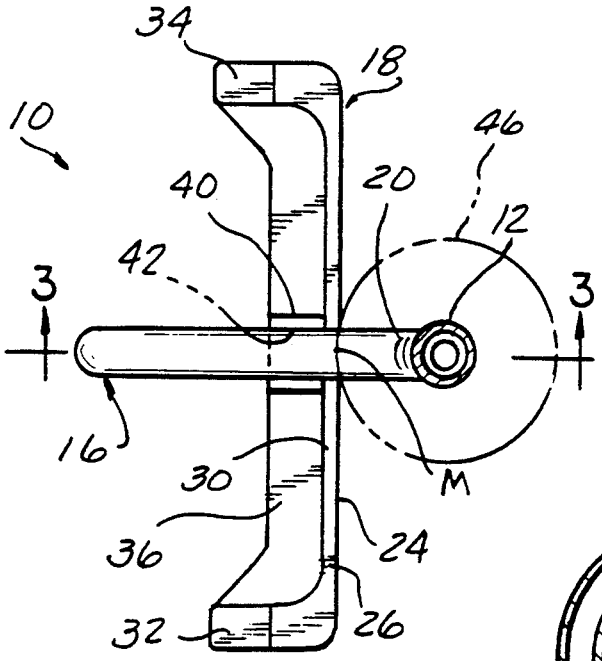
FIG. 2 is a plan view of the golf putter shown in FIG. 1.

The club head 18 may have any configuration, such as a generally cubical, solid configuration, or it may be provided with a rear interior cavity as shown in FIGS. 1–4. The interior cavity is becoming more popular since it places a greater percentage of the overall weight of the club head 18 at a lower portion of the club head 18 adjacent the bottom surface 28 and at the opposed sides or toe 32 and heel 34 portions thereof. As shown in FIGS. 1–3, an interior cavity is formed on the club head 18 by means of an enlarged base portion 36 which extends outward from a 10 bottom portion of the rear or back wall 30 of the club head 18 and opposed end sections extending generally perpendicularly from the rear wall 30 and forming the toe 32 and the heel 34 of the club head 18.

A hosel 40 is formed on the club head 18, typically as an integral part of the back wall 30 of the club head 18. An internal bore 42 extends into the hosel 40 for a predetermined distance. The bore 42 is designed to snugly receive the end leg 22 of the arcuate section 16 connected to the shaft 12 to attach the shaft 12 to the club head 18.

In a preferred embodiment, the longitudinal axis of the bore 42 in the hosel 40, denoted by reference number 44 in FIG. 3, is centered between the top surface 26 and the sole 28 of the club head 18. In a more preferred embodiment, the longitudinal axis 44 extending through the bore 42 in the hosel 40 is spaced a predetermined distance from the bottom surface 28 of the club head 18 equal to the radius of a standard golf ball 46. Further, the longitudinal axis 44 extending through the hosel 40 is centered between the lateral sides or toe 32 and heel 34 of the club head 18. This arrangement plates the meet point M, which is the ideal point of contact between the striking face 24 of the club head 18 and the golf ball 46, at the exact center of the club head 18. This results in an efficient transfer of golf swing energy or inertia from the golf putter 10 to the golf ball 46. This energy transfer which is centered directly through the golf ball 46 directs the golf ball 46 in its intended direction of movement without substantial variation therefrom.

It should also be noted that the length of the end leg 22 of the arcuate section 16 connected to the shaft 12 has a predetermined length such that when the end leg 22 is mounted in the hosel 40 on the club head 18, the striking face 24 of the club head 18 is spaced a predetermined distance from a longitudinal axis 48 extending through the shaft 12. In a preferred embodiment, the distance between the striking face 24 of the club head 18 and the longitudinal axis 48 of the shaft 12 is equal to the radius of a standard golf ball 46.

In the embodiment depicted in FIGS. 1–4, the shaft 12 is oriented with respect to the club head 8 such that a plane containing the longitudinal axis 48 of the shaft 12 and the arcuate section 16 is substantially perpendicular to the plane of the striking face 24 of the club head 18 perpendicular to the top surface 26 of the club head 18. This centers the shaft 12 directly over the center of a standard golf ball 46 when the striking face 24 of the club head 18 is brought into contact with the golf ball 46.

In use, a player will select the desired path of movement for the golf ball 46 and position the club head 18 adjacent the golf ball 46 with the striking face 24 of the club head 18 perpendicular to such intended path of movement. During the swing, the player can continually maintain the club head 18 perpendicular to the intended path of movement of the golf ball 46 and avoid or correct any tendency to open or close the striking face 24 with respect to the golf ball 46 by maintaining the longitudinal axis 44 extending through the hosel 40 and the arcuate section 16 connected between the hosel 40 on the club head 18 and the shaft 12 in line with the intended path of movement of the golf ball 46. If any opening or closing of the club head 18 occurs during the swing, the player can easily detect such a condition and make adjustments during the swing so as to bring the striking face 24 of the club head 18 into substantial perpendicularity to the intended path of movement at the point of contact with the golf ball 46. This results in a more accurate putt in that the swing energy of the golf putter 10 is efficiently transferred to the center of the golf ball 46 and the club head 18 contacts the golf ball 46 in a position substantially perpendicular to the path of movement of the golf ball 46 so as to propel the golf ball 46 in its intended path of movement without any angular component of motion added thereto.

Figure 5:
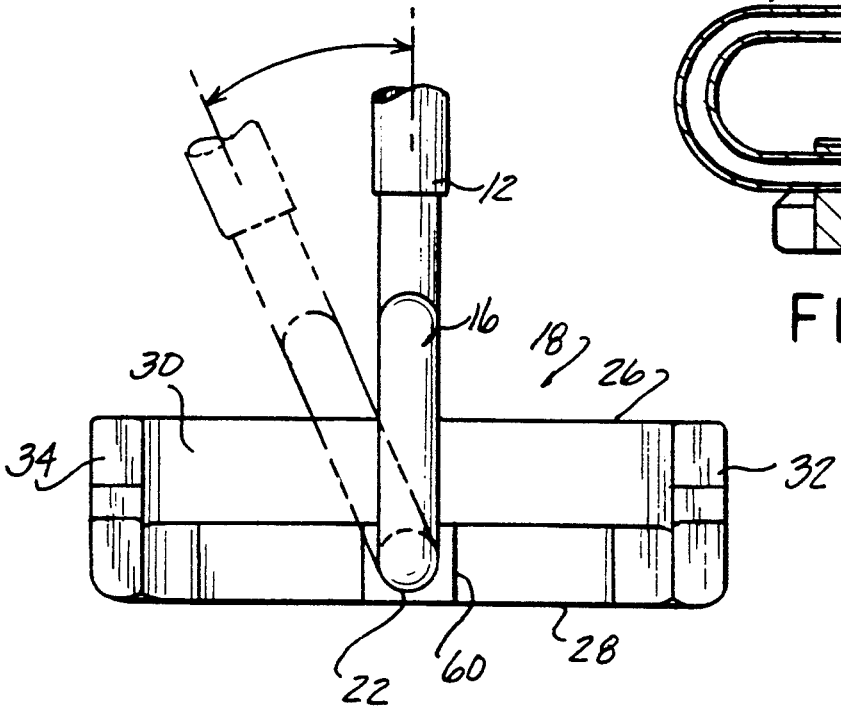
FIG. 5 is a back view of another embodiment of a golf putter according to the present invention.

Another embodiment of the golf putter of the present invention is depicted in FIG. 5. In this embodiment, the shaft 12 and the club head 18 are formed substantially as described above and shown in FIGS. 1–4. However, the hosel 60 in the embodiment shown in FIG. 5 is positioned closer to the sole of the club head 18 such as by being formed as an integral part of the enlarged base 36 extending outward from the rear surface 30 of the club head 18. However, the hosel 60 is still centered between the lateral sides or toe 32 and heel 34 of the club head 18.

In this embodiment, the shaft 12 and the attached arcuate section 16 are initially loosely or movably connected to the club head 18 at the second end leg 22 of the arcuate section 16 and the hosel 60 so as to be variably positioned at any angle from a perpendicular line extending up from the club head 18 as shown in phantom in FIG. 5. The angle of the longitudinal axis 48 of the shaft 12 with respect to the club head 18 is selected to suit the particular size, height and body part relationship of a golfer so as to enable the golfer to consistently swing the golf putter 10 in a manner which brings the striking face 24 of the club head 18 into a perpendicular position when the striking face 24 contacts a golf ball 46. When the desired angle is determined, the second end leg 22 of the arcuate section 16 connected to the shaft 12 is then fixedly connected to the hosel 60 by means of adhesive or other suitable fastening means.

In summary, there has been disclosed a unique golf putter which provides an efficient energy transfer from the swing of the putter through the center of a golf ball. The unique attachment of an arcuate section connected to the end of the golf putter shaft to the rear surface of the club head at a position centered between the toe and heel portions of the club head and, preferably, at a vertical distance from the sole of the club head equal to the radius of a standard golf ball transfers the golf swing energy or inertia directly through the center of the golf ball to propel the golf ball more accurately along its intended path of movement. The connection between the shaft and the club head at the lateral center of the club head insures that the striking face of the club head consistently meets the golf ball in a substantial perpendicular position to a plane extending through the center of the golf ball and aligned with the intended path of movement of the golf ball to prevent any angular deviation of the golf ball from its intended path of movement. The golf putter of the present invention also connects the shaft to the club head at a substantial perpendicular position with respect to the striking face of the club head. In addition, the shaft may be movably, angularly disposed from such perpendicular position to suit the particular size of a golfer before being fixedly connected to the hosel mounted on the club head.

What is claimed is:

1. A golf putter comprising:

an elongated linear shaft having a hand grip end and an opposed end;

a club head having a top surface, a sole, a heel, a toe, a planar striking face, and a back wall opposed to the striking face;

a hosel mounted on the back wall of the club head substantially centered between the heel and toe, a longitudinal axis extending centrally through the hosel spaced from the sole of the club head at a distance equal to the radius of a golf ball;

an arcuate shaft section connecting the opposed end of the shaft and the hosel; and the shaft having a longitudinal axis extending between the hand grip end and the opposed end, the longitudinal axis of the shaft and the arcuate shaft section being co-planar in a first plane disposed substantially perpendicular to the plan of the striking face of the club head.

2. The golf putter of claim 1 wherein the hosel is substantially centered between the top and sole of the club head.

3. The golf putter of claim 1 wherein:

the arcuate shaft section includes an end leg mounted in and fixedly connected to the hosel, the end leg disposed in parallel to the sole of the club head.

4. The golf putter of claim 1 wherein:

the arcuate shaft section includes an end leg connected to the hosel, the end leg having a predetermined length such that when the end leg is connected to the hosel, the striking face of the club head is spaced behind the longitudinal axis extending through the shaft at a distance substantially equal to the radius of a golf ball.

5. The golf putter of claim 1 wherein:

the arcuate shaft section has an end leg connected to the hosel, the end leg being substantially linear and disposed in parallel to the sole of the club head; and the arcuate shaft section smoothly curving from the end leg to a spaced end connected to the opposed end of the shaft.

6. The golf putter of claim 1 wherein the hosel includes an open-ended bore for fixedly receiving one end of the arcuate shaft section therein.

7. The golf putter of claim 1 wherein:

the longitudinal axis of the shaft being spaced in front of the striking face of the club head at a distance substantially equal to the radius of a golf ball.

8. The golf putter of claim 1 wherein:

the arcuate shaft section is integrally formed as a continuous unitary extension of the shaft.

9. The golf putter of claim 1 wherein:

the first plane containing the arcuate shaft section and the longitudinal axis extending through the shaft is disposed perpendicular to the top surface of the club head.

10. A golf putter comprising:

an elongated linear shaft having a hand grip end and an opposed end;

a club head having a top surface, a sole, a heel, a toe, a planar striking face, and a back wall opposed to the striking face;

a hosel mounted on the back wall of the club head substantially centered between the heel and toe;

an arcuate shaft section extending and connected between the opposed end of the shaft and the hosel, the arcuate shaft section including an end leg mounted in and fixedly connected to the hosel, the end leg disposed substantially parallel to the sole of the club head;

the hosel and the end leg of the arcuate shaft section being positioned with respect to the sole of the club head such that an axis extending centrally through the end leg and the hosel is spaced from the sole of the club head at a distance equal to the radius of a golf ball; and the shaft having a longitudinal axis extending between the hand grip end and the opposed end, the longitudinal axis of the shaft being spaced in from of the striking face of the club head at a distance substantially equal to the radius of a golf ball, the longitudinal axis of the shaft and the arcuate shaft section being co-planar in a first plane substantially perpendicular to the plane of the striking face of the club head, the first plane being perpendicular to the top surface of the club head.

* * * * *